US008607373B2

(12) United States Patent
Van Schenk Brill

(10) Patent No.: US 8,607,373 B2
(45) Date of Patent: Dec. 17, 2013

(54) POOL FLUID CONTROL SYSTEM

(76) Inventor: Hans Van Schenk Brill, Sewell, NJ (US)

( * ) Notice: Subject to any disclaimer, the term of this patent is extended or adjusted under 35 U.S.C. 154(b) by 629 days.

(21) Appl. No.: 12/807,941

(22) Filed: Sep. 18, 2010

(65) Prior Publication Data

US 2012/0066827 A1 Mar. 22, 2012

(51) Int. Cl.
*E04H 4/00* (2006.01)

(52) U.S. Cl.
USPC ..... 4/509; 4/507

(58) Field of Classification Search
USPC ..... 4/507–509
See application file for complete search history.

(56) References Cited

U.S. PATENT DOCUMENTS 2,900,079 A * 8/1959 Pace ..... 210/167.12
4,022,690 A * 5/1977 Smith ..... 210/167.1
7,727,387 B2 * 6/2010 Goggin ..... 210/167.12

* cited by examiner

*Primary Examiner* — Huyen Le
(74) *Attorney, Agent, or Firm* — Stuart M. Goldstein

(57) ABSTRACT

A pool fluid control system utilizes a fluid collection tank having an intake enclosure extending therefrom. The intake enclosure has an open grate which is configured to be positioned flush with the pool wall. Water which accumulates between the pool wall and the liner flows through the grate, into the intake enclosure, and then into the collection tank. A sump pump or other submersible pump within the collection tank then discharges the water out of the collection tank for disposal at a location away from the pool. This constant monitoring and then automatic removal of unwanted water from the space between the liner and the pool wall serves to maintain the integrity of the liner in relation to the wall.

16 Claims, 2 Drawing Sheets

POOL FLUID CONTROL SYSTEM

BACKGROUND OF THE INVENTION

It is a common practice to use a pool liner in both in-ground and above-ground pools. While pool liners are utilized as a means for providing decorative pool walls, their most important function is to ensure the watertight integrity of the pools. There are a variety of ways to connect and retain pool liners to the top of pools, but it is the hydrostatic pressure of the water in the pools which maintains the liners in position against the pool walls. And it is very important that liners remain adjacent to the pool walls in order to successfully accomplish their watertight function.

However, many pools, especially those which are several years old, will experience what is known as "floating liners." A liner will "float" when water finds its way into the space between the liner and the pool walls. This water can enter the space by means of leakage through the walls or floors of the pools or through loose pipe/filter connections. A common source of unwanted water into this space is from groundwater which builds up around the pool due to landscaping changes around the pool area, slowing of the water absorption rate of the adjacent ground, and the natural settling of the ground under and around the pool. When the ground settles beneath the pool, channels are formed around the pool's outside perimeter and water fills the channels. The water and hence the water pressure builds up in this area, forcing water into the pool and under the liner, eventually causing it to "float" away from the pool walls.

There are a number of tell-tale signs which indicate that a pool has a floating liner. Such signs include a liner which has slipped out of its tracking, the appearance of wrinkles around step areas and at the shallow end of the pool, a liner which is coming off the pool walls and floor, and large bubbles in the shallow end of the pool.

Currently, there are only limited ways to address the problem of a floating liner. The landscaping around the pool can be rerouted so that the surface water is redirected away from the pool. A permanent foot valve system can be installed or a submersible pump can be inserted in the space between the liner and the wall. The entire pool can be drained and the liner reset or replaced and the pool refilled. None of these alternatives will permanently solve the problem of fluid or water buildup which results in a floating liner.

SUMMARY OF THE INVENTION

It is thus the object of the present invention to provide a pool fluid control system to overcome the disadvantages and limitations of existing practices used to address the problem of floating pool liners.

It is the object of the present invention to provide a pool fluid control system which is permanently installed adjacent to a swimming pool and which automatically and effectively accumulates and discharges unwanted water which builds up in the space between the pool liner and the walls of the pool, thereby maintaining the integrity and positioning of the liner within the pool.

It is another object of the present invention to provide a pool fluid control system which can be economically manufactured and installed in both existing and new in-ground and above-ground pools to address the problem of the floating pool liner.

These and other objects are accomplished by the present invention, a pool fluid control system which comprises a fluid collection tank having an intake enclosure extending therefrom. The intake enclosure has an open grate which is configured to be positioned flush with the pool wall. Water which accumulates between the pool wall and the liner flows through the grate, into the intake enclosure, and then into the collection tank. A sump pump or other submersible pump within the collection tank then discharges the water out of the collection tank for disposal at a location away from the pool. This constant monitoring and then automatic removal of unwanted water from the space between the liner and the pool wall serves to maintain the integrity and positioning of the liner in relation to the wall.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
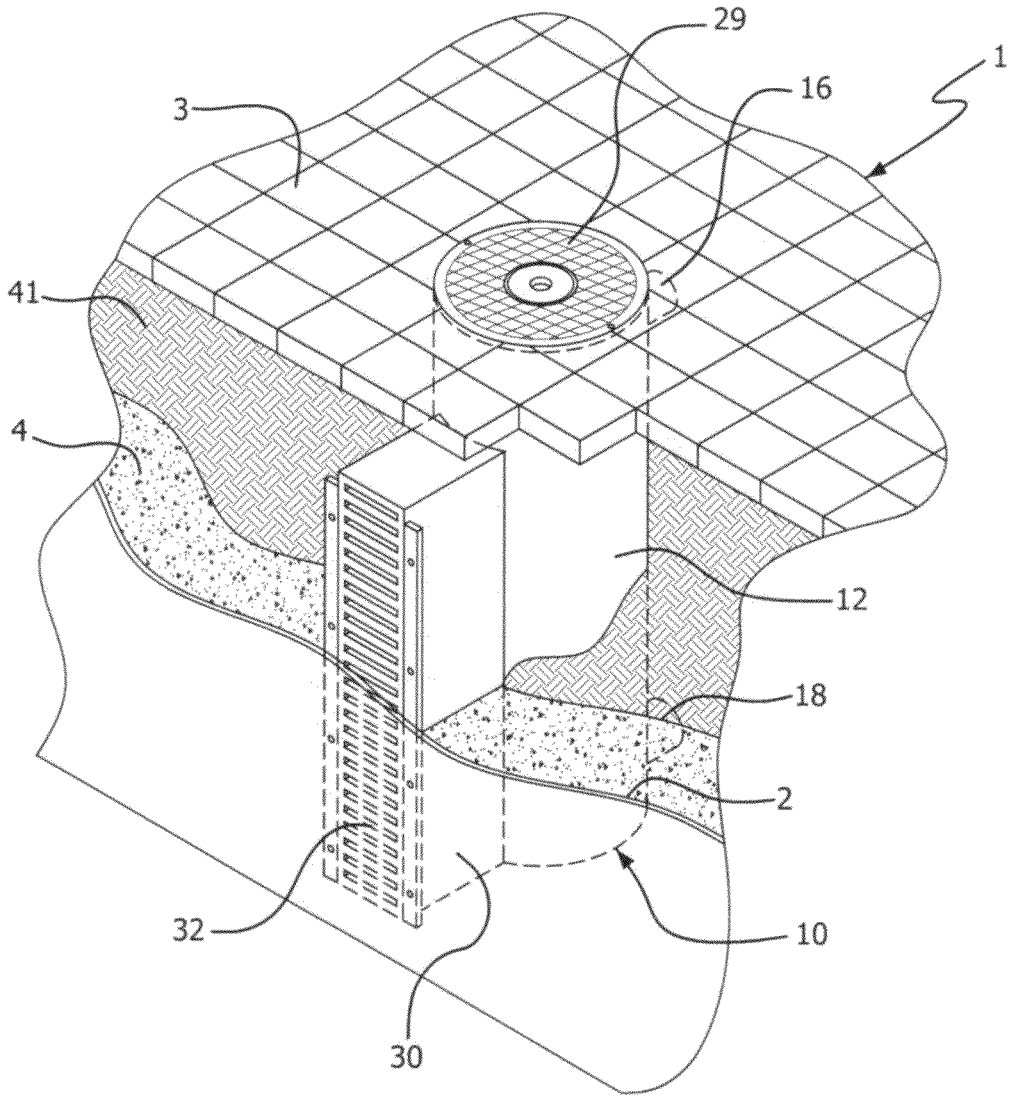
FIG. 1 is an isometric, partially sectional view of the pool fluid control system of the present invention installed with an in-ground pool.

Fluid control system 10 of the present invention is designed to be permanently incorporated as part of swimming pool 1 pool deck 3. Pool also comprises inside pool liner 2. Liner 2 is secured to the edge of pool 1 by any of the variety of means known in the art, and maintained in position against the interior pool walls, e.g. interior pool wall 4, by means of the hydrostatic pressure 5 against the liner provided by water 6 in the pool, as best shown in FIG. 1.

Fluid control system 10 comprises hollow collection tank 12 having internal fluid intake opening 14, fluid discharge port 16 and external fluid intake port 18. Sump or equivalent pump 24 is located at the bottom of collection tank 12. Fluid discharge line 26 and electric line 28 extend from pump 24, through collection tank 12 and out through fluid discharge port 16 and discharge piping 27. Collection tank 12 is open at its top 20 for ease of access into the tank. Removeable cover 29 is provided to close the top of collection tank 12.

Intake enclosure 30 extends laterally out from collection tank 12. Fluid intake opening 14 is located between collection tank 12 and intake enclosure 30. The inboard wall of intake enclosure 30 comprises fluid intake grate 32, which extends substantially the vertical length of intake enclosure 30.

Figure 2:
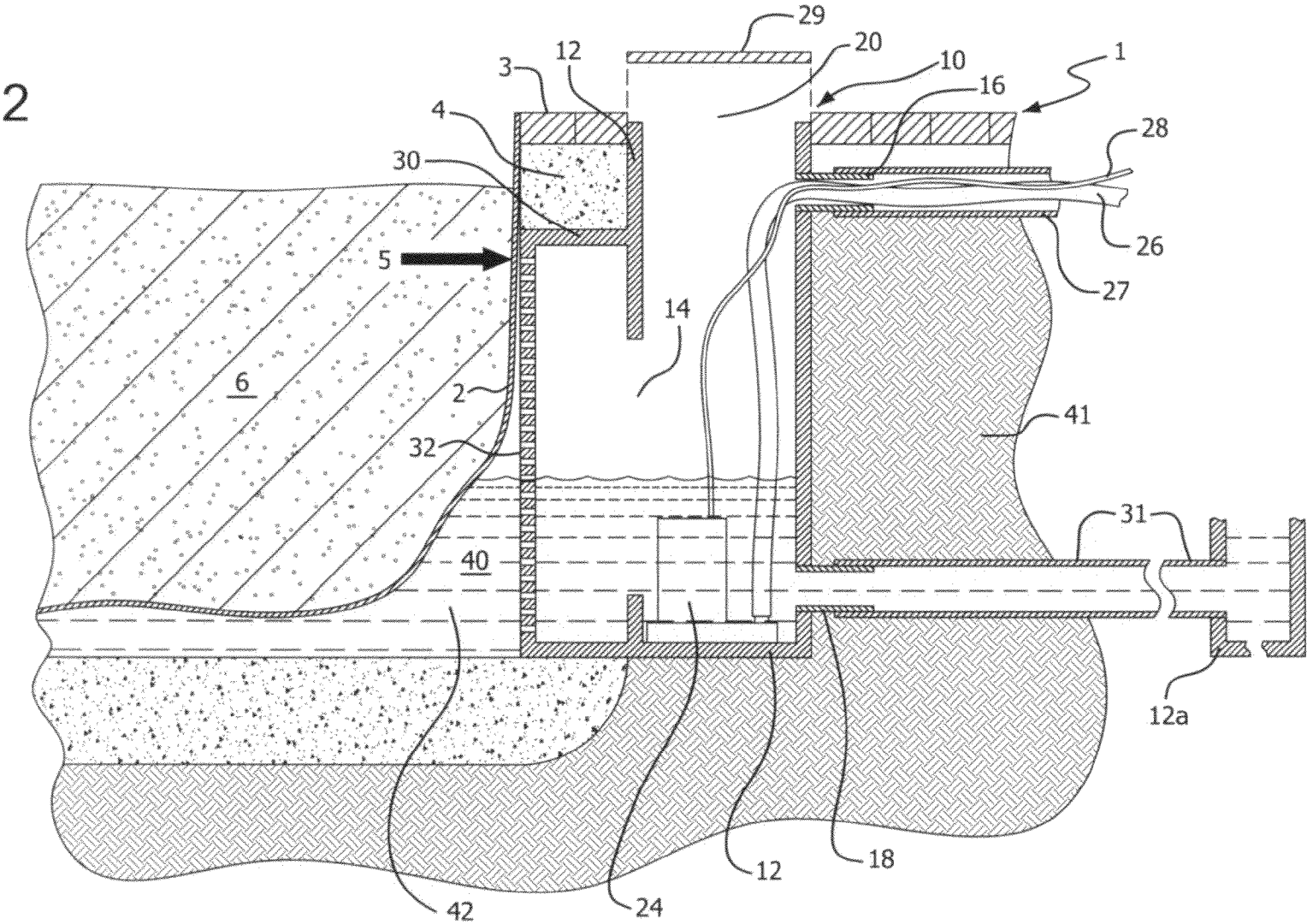
FIG. 2 is an elevation, cross-sectional view of the pool fluid control system of the present invention in its operating mode for the removal of unwanted water from the liner of a pool.

For in-ground swimming pools, as shown in FIGS. 1 and 2, fluid control system 10 is embedded within the ground, adjacent to the pool. An opening is provided within interior pool wall 4 of pool 1 which is substantially the same size as intake enclosure 30. Intake enclosure 30 is positioned in this opening within pool wall 4, such that intake grate 32 is substantially flush with the wall, as clearly seen in FIGS. 1 and 2. Liner 2 would normally be properly positioned and maintained within pool 1 by hydrostatic pressure 5, such that it lays over and atop grate 32. See the upper section of liner 2 in FIG. 2.

As previously discussed, outside fluid, e.g. ground water 40, will leak into or seep in from the adjacent ground 41, through the walls of pool 1, accumulating in space 42 located between the pool walls, e.g. pool wall 4, and liner 2; thus compelling the liner away from the wall. See the lower section of liner 2 in FIG. 2. As this fluid 40 accumulates in space 42, it will ultimately flow through grate 32, into intake enclosure 30, through internal fluid intake opening 14, and then into collection tank 12. Once the level of the fluid rises to the designated level within collection tank 12, pump 24 will operate to pump the fluid through fluid discharge line 26 and out of collection tank via fluid discharge port 16 and discharge piping 27, where it is discharged to a location away from the pool. In this manner, fluid which accumulates in space 42, between wall 4 and liner 2, is constantly monitored and automatically and effectively removed, thus maintaining the integrity and positioning of the liner in relation to the pool walls.

For larger pools or ones with more serious leakage problems, more than one collection tank/intake enclosure unit of the present invention, e.g. 12*a* shown in FIG. 2, can be embedded adjacent to a single pool, each unit having respective grates flush with different pool walls. In such cases, it is contemplated that fluid lines from these enclosure units will be run, via discharge piping 31, to fluid intake port 18 of a primary unit, i.e. to collection tank 12, which houses pump 24. In this manner, fluid which builds up between liner 2 and any number of pool walls can flow into collection tank 12 and then be expelled, via pump 24, through discharge line 26.

Although FIGS. 1 and 2 and the discussion regarding these figures are directed to the use of control system 10 with an in-ground pool, it is contemplated that the system can be utilized with equal success in conjunction with above-ground pools as well.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A fluid control system for maintaining the integrity and positioning of a swimming pool liner within a swimming pool having internal pool walls, said system comprising:

fluid intake means positioned within an interior pool wall of a swimming pool for allowing the entry of accumulating fluid;

fluid collection means for receiving accumulated fluid from the fluid intake means, said fluid collection means comprising a fluid intake opening and a fluid discharge port; and pump means within the fluid collection means for discharging accumulated fluid from the fluid collection means, whereby said fluid accumulating within a space between the interior pool wall and a swimming pool liner located within the pool flows into the fluid intake means to the fluid collection means and is then discharged from the fluid collection means through the fluid discharge port, thereby maintaining the integrity and positioning of the liner within the swimming pool.

2. The fluid control system as in claim 1 further comprising a second fluid collection means for receiving accumulated fluid.

3. The fluid control system as in claim 2 wherein the fluid collection means further comprises a fluid intake port for receiving accumulated fluid from the second fluid collection means.

4. The fluid control system as in claim 1 wherein the fluid collection means further comprises a fluid intake port.

5. The fluid control system as in claim 1 wherein the fluid intake means comprises an intake enclosure with an external grate which is substantially flush with the interior wall, whereby accumulated fluid enters the grate and then into the enclosure.

6. The fluid control system as in claim 5 wherein the fluid intake opening is located between the enclosure and the fluid collection means.

7. A swimming pool having internal walls, a swimming pool liner adjacent to the walls, and a fluid control system for maintaining the integrity and positioning of the swimming pool liner within the swimming pool, said fluid control system comprising:

fluid intake means positioned within an interior pool wall of the swimming pool for allowing the entry of accumulated fluid;

fluid collection means for receiving accumulated fluid from the intake means, said fluid collection means comprising a fluid intake opening and a fluid discharge port; and pump means within the fluid collection means for discharging accumulated fluid from the fluid collection means, whereby said fluid accumulating within a space between said interior pool wall and the swimming pool liner flows into the fluid intake means to the fluid collection means and is then discharged from the fluid collection means through the fluid discharge port, thereby maintaining the integrity and positioning of the liner within the swimming pool.

8. The swimming pool as in claim 7 in which the fluid control system further comprises a second fluid collection means for receiving accumulated fluid.

9. The fluid control system as in claim 8 wherein the fluid collection means further comprises a fluid intake port for receiving accumulated fluid from the second fluid collection means.

10. The fluid control system as in claim 7 wherein the fluid collection means further comprises a fluid intake port.

11. The fluid control system as in claim 7 wherein the fluid intake means comprises an intake enclosure with an external grate which is substantially flush with the interior wall, whereby accumulated fluid enters the grate and then into the enclosure.

12. The fluid control system as in claim 11 wherein the fluid intake opening is located between the enclosure and the fluid collection means.

13. A fluid control system for maintaining the integrity and positioning of a swimming pool liner within a swimming pool having internal pool walls, said system comprising:

a fluid collection tank having a fluid intake opening and a fluid discharge port;

an intake enclosure extending laterally out from the collection tank and through an internal pool wall, the fluid intake opening being located between the collection tank and the intake enclosure, said intake enclosure comprising an external grate which is substantially flush with the interior pool wall; and pump means within the collection tank for discharging fluid which accumulates within the collection tank, whereby said fluid accumulating within a space between said interior pool wall and the swimming pool liner enters the grate and flows into the intake enclosure to the collection tank and is then discharged from the collection tank through the fluid discharge port, thereby maintaining the integrity and positioning of the liner within the swimming pool.

14. The fluid control system as in claim 13 further comprising a second fluid collection tank.

15. The fluid control system as in claim 14 wherein the fluid collection tank further comprises a fluid intake port for receiving accumulated fluid from the second fluid collection tank.

16. The fluid control system as in claim 13 wherein the fluid collection means further comprises a fluid intake port.

* * * * *